US005878701A

United States Patent [19]

Kahlhamer

[11] Patent Number: 5,878,701

[45] Date of Patent: Mar. 9, 1999

[54] CYLINDER HEAD FOR AN INTERNAL COMBUSTION ENGINE AND METHOD OF ADJUSTABLY ESTABLISHING THE VOLUME OF A COMBUSTION CHAMBER THEREIN

[75] Inventor: Bruce R. Kahlhamer, Wild Rose, Wis.

[73] Assignee: PSI Performance, Wild Rose, Wis.

[21] Appl. No.: 923,482

[22] Filed: Sep. 4, 1997

Related U.S. Application Data

[60] Provisional application No. 60/025,598 Sep. 6, 1996.

[51] Int. Cl. [6] ..... F02D 15/04; F22B 75/04

[52] U.S. Cl. ..... 123/48 A; 123/78 A

[58] Field of Search ..... 123/48 R, 48 A, 123/48 AA, 78 R, 78 A

[56] References Cited

U.S. PATENT DOCUMENTS

| | | | |
|---|---|---|---|
| 1,795,309 | 3/1931 | Marshall | 123/48 A |
| 2,120,012 | 6/1938 | Andreau | 123/48 AA |
| 2,592,829 | 4/1952 | Skinner | 123/48 AA |
| 2,733,694 | 2/1956 | Brebeck | 123/48 AA |
| 2,914,048 | 11/1959 | Philipp | 123/48 A |
| 4,190,024 | 2/1980 | Davis | 123/48 A |
| 5,427,063 | 6/1995 | Anderson | 123/48 A |

FOREIGN PATENT DOCUMENTS

| | | | |
|---|---|---|---|
| 0488431 | 3/1992 | European Pat. Off. | 123/48 AA |
| 45852 | 4/1919 | Germany | 123/48 A |
| 3-258930 | 11/1991 | Japan | 123/48 R |
| WO 91/14860 | 10/1991 | WIPO | 123/48 A |

*Primary Examiner*—David A. Okonsky
*Attorney, Agent, or Firm*—James H. Beusse; Holland & Knight LLP

[57] ABSTRACT

A cylinder head has a head portion for attachment to an engine cylinder of an internal combustion engine, and a combustion chamber dome is adjustably received in a central aperture of the head portion. External circumscribed threads on the combustion chamber dome engage corresponding threads in the central aperture of the head portion so that the combustion chamber dome may be adjustably moved into a preselected adjusted position within the central aperture by rotation of the combustion chamber dome with respect to the head portion.

A method of adjustably establishing a combustion chamber in a cylinder of 1 an internal combustion engine is also disclosed.

15 Claims, 4 Drawing Sheets

CYLINDER HEAD FOR AN INTERNAL COMBUSTION ENGINE AND METHOD OF ADJUSTABLY ESTABLISHING THE VOLUME OF A COMBUSTION CHAMBER THEREIN

This application claims the benefit of provisional patent application, Ser. No. 60/025,598, filed Sep. 6, 1996.

FIELD OF THE INVENTION

This invention relates in general to internal combustion engines and in particular to a cylinder head therefor and also to a method of adjustably establishing the volume of a combustion chamber in a cylinder of an internal combustion engine.

BACKGROUND OF THE INVENTION

Two-cycle internal combustion engines are characterized by one or more cylinders consisting essentially of cylindrical bores within an engine or cylinder block. A piston fits within the cylinder such that it can move reciprocally. One end of the cylinder is closed by a cylinder head to establish a combustion chamber between a top surface of the piston and the cylinder head. The two-cycle cylinder construction differs from four-cycle cylinder construction in that the latter incorporates intake and exhaust valves in the cylinder head while the two-cycle engine has intake and exhaust ports in a wall of the cylinder.

When the piston is reciprocated to its lowest position in the cylinder, the maximum volume of the cylinder is defined. The minimum volume of the cylinder is defined when the piston is at its highest reciprocated position in the cylinder. The ratio of maximum volume to minimum volume is referred to as the compression ratio, and the greater the compression ratio, the more efficient the engine. It is believed that in most internal combustion engines, the cylinder head is manufactured with a shaped pocket or chamber, such as a dome or the like for instance, which defines the cylinder volume at the highest piston position, i.e., the aforementioned maximum volume, and therefore directly effects the performance of the engine.

It is believed that there were many past applications which required changes in cylinder head design, and such changes may have been necessitated not only by a need to vary engine compression ratio but also to adapt an engine for different octane rated fuels or for different fuels. The most common practice was to modify cylinder heads in order to develop high performance engines, and it is believed that the most common modifications to such cylinder heads was to alter the size and/or shape or the position of the combustion chamber. However, in some applications such as in racing for instance, it was often desirable to modify a cylinder head to obtain performance characteristics for the racing internal combustion engine demanded or suitable to meet immediate racing conditions. Since machining of cylinder heads to meet such immediate racing conditions was not practiced at such racing events, one of the problems presented at such racing events was the necessity of carrying and maintaining many different cylinder heads as replacement parts.

In order to overcome the aforementioned problem of carrying replacement cylinder heads, U.S. Pat. No. 4,825,817 disclosed the use of a plurality of different replaceable combustion chamber housings which could be utilized with a complementary cylinder head in order to effect different desired modifications in engine performance. However, one of the problems involved in this above discussed patented scheme is believed to be that it was necessary to carry many different ones of combustion chamber housings as replacement parts.

SUMMARY OF THE INVENTION

In general, a cylinder head for an internal combustion engine is provided in one form of the invention with a head portion adapted for attachment to an engine cylinder, and the head portion has a central aperture for receipt of an adjustable combustion chamber dome. The dome has external circumscribed threads for engaging corresponding threads on an inner surface of the aperture so that the dome can be adjustably moved into a preselected adjusted position within the aperture by rotation of the dome with respect to the head portion.

Further in general and in one form of the invention, a method is provided for adjustably establishing the volume of a combustion chamber in a cylinder of an internal combustion engine. The cylinder includes a cylinder head and an adjustable means associated with the cylinder head for in part defining the combustion chamber in the cylinder. In the practice of this method, a manual rotative force is exerted on the adjustable means, and the adjustable means is rotated relative to the cylinder head in response to the manual rotative force. The rotation of the adjustable means effected in response to the manual rotative force is translated into vertical adjusting movement of the adjustable means relative to the cylinder head, and the volume of the combustion chamber is varied in response to the vertical adjusting movement of the adjustable means.

BRIEF DESCRIPTION OF THE DRAWINGS

Corresponding reference characters indicate corresponding parts throughout the several view of the drawings.

The exemplifications set out herein illustrate the preferred embodiments of the invention in one form thereof, respectively, and such exemplifications are not to be construed in any manner as limiting either the scope of this disclosure or the scope of the present invention.

DETAILED DESCRIPTION OF THE PREFERRED EMBODIMENTS

Figure 1:
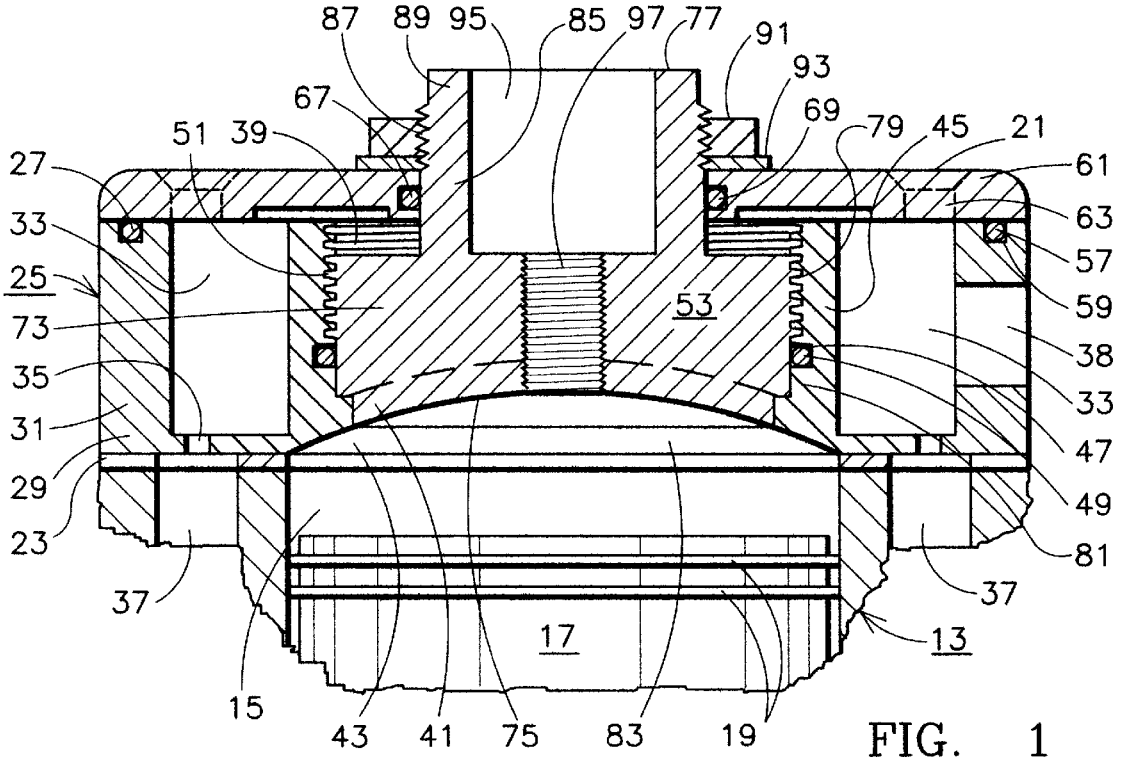
FIG. 1 is a sectional view showing a cylinder head in one form of the invention in cross-section associated with a cylinder in an engine block of an internal combustion engine and illustrating principles which may be practiced in a method of establishing the volume of a combustion chamber in a cylinder of an internal combustion engine also in one form of the invention.

With reference now to FIG. 1 of the drawings in detail, there is shown a cylinder head or cylinder head assembly 11 in one form of the invention arranged on an engine block 13 of an internal combustion engine (not shown), and the engine block is provided with a cylindric bore or cylinder 15 including a piston 17 reciprocally movable therein which carries multiple oil or piston rings 19 in sealing engagement with the cylinder. Cylinder head 11 is removably secured by suitable means, such as a plurality of mounting bolts 21 or the like for instance, to engine block 13 in enclosing relation about cylinder 15. A cylinder head gasket 23 is sealably interposed between the interface of cylinder head 11 and engine block 13 acting to prevent leakage of gases from cylinder 15 and also to prevent the leakage of cooling fluid which may be circulated from the engine block into the cylinder head, as well known to the art. While engine block 13 of the aforementioned internal combustion engine may be provided with a plurality of cooperating cylinder heads 11 and cylinders 15, only the cylinder head and cylinder shown in FIG. 1 is discussed hereinafter for the purpose of brevity of disclosure and drawing simplification.

Figure 2:
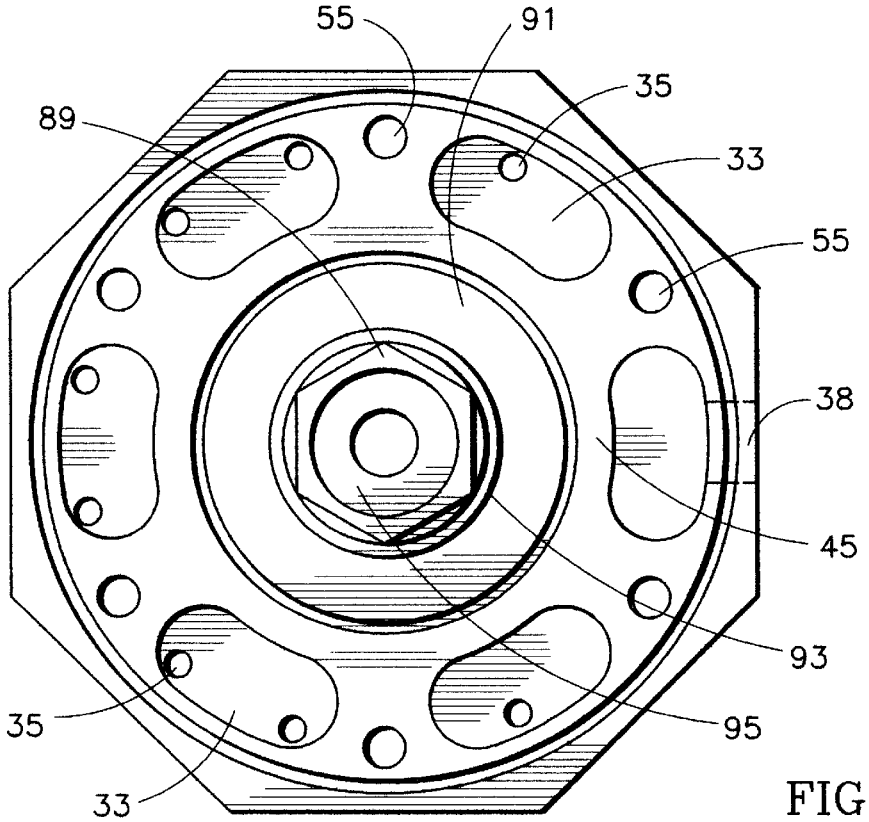
FIG. 2 is a plan view of the cylinder head of FIG. 1 with a cover thereof removed for clarity.

Considering now also FIG. 2 in combination with FIG. 1, cylinder head 11 is provided with a housing or head portion 25 which may be formed of any suitable metallic material, such as aluminum or the like for instance. Housing 25 has a pair of generally opposite end faces or end walls 27,29 with a sidewall 31 interposed therebetween, and while the sidewall is illustrated having a six-sided configuration, it is contemplated that the housing may be provided with various other sidewall configurations, including circular, within the scope of the present invention. Of course, lower end face 29 is sealably seated against gasket 23 on engine block 13, and a plurality of cavities or chambers 33 for cooling fluid are provided in housing 25 being arranged in spaced relation adjacent sidewalls 31. Chambers 33 intersect upper end face 27 of housing 25, and a plurality of passages 35 are provided in the housing intersecting with the chambers and lower end face 29, respectively. Housing passages 35 respectively communicate with cooperating passages 37 in engine block 13 thereby providing a means for circulating a cooling fluid (not shown) between the engine block and cooling fluid chamber 33 in housing 25, and gasket 23 is sealably arranged about passages 35, 37 to prevent fluid leakage at the interface between housing 25 and block 13. A cooling fluid port 38 is provided through sidewall 31 of housing 25 connecting with one of cooling chambers 33, and while the cooling fluid port is adapted for connection in communication with engine block 13 for the circulation of cooling fluid therebetween, such connection is omitted for the purpose of drawing simplification.

A central aperture, such as a pair of stepped bores 39, 41 or the like for instance, is generally centrally or axially provided in housing 25 with the larger stepped bore 39 intersecting upper end face 27 on the housing and the smaller stepped bore 41 intersecting a generally annular tapered squish chamber 43 provided in lower end face 29 of the housing so as to extend generally about the upper end of cylinder 15 in engine block 13. A generally thin annular inner wall 45 is integrally formed in housing 25 being disposed in heat transfer relation generally radially between stepped bores 39, 41 and cooling fluid chambers 33, and a generally annular groove 47 undercut in inner wall 45 intersects larger stepped bore 39 to define a seat for a suitable sealing means, such as O-ring seal 49 or the like for instance. Thus, it may be noted that a relatively thin wall section is predeterminately established in inner wall 45 between O-ring groove 47 and cooling fluid chambers 33 to enhance the flow of heat away from O-ring 49, as discussed in greater detail hereinafter. A section of larger stepped bore 39 is threaded at 51 between O-ring groove 47 and upper end face 27 of the housing for threaded engagement with an adjustable means 53, as also further discussed hereinafter. To complete the description of housing 25, a plurality of mounting bolt receiving openings or holes 55 disposed between adjacent cooling fluid chamber 33 extend through the housing intersecting opposite end faces 27,29 thereof, respectively, and a suitable sealing means, such as for instance, an O-ring 57, or the like, is sealably received or seated in an annular groove 59 provided therefore in upper end face 27 with the groove extending generally in circumscribing relation about cooling fluid chambers 33 and mounting bolt holes 55.

A top cover or cover plate 61 may be formed of any suitable metallic material, such as for instance aluminum or the like. Cover 61 is removably arranged with upper end face 27 of housing 25 in sealing relation with O-ring 59, and a plurality of mounting bolt receiving openings 63 in the cover are disposed to align with mounting bolt holes 55 in the housing. Albeit not shown for the purpose of drawing simplification, mounting bolts 21 extend through cover openings 63 and housing holes 55 into threaded engagement with engine block 13 so as to releasably retain cover 61 against displacement from housing 25 and to releasably retain the housing against displacement from the engine block in a manner well known to the art. A generally central opening or bore 65 is provided through cover 61 so as to be axially aligned with stepped bores 39, 41 in housing 25 when the cover is mounted thereto by mounting bolts 21, as discussed above, and suitable sealing means, such as for instance, an O-ring 69 or the like, is sealably received or seated in an annular groove 67 provided therefore in bore 65 with O-ring 69 being sealably engaged with adjustable means 53, as further discussed hereinafter. To complete the description of cover 61, an annular recess 71 in the cover serves to interconnect cooling fluid chambers 33 so as to form with the cooling fluid chambers and the annular recess forming liquid or cooling fluid flow paths in cylinder head 11 for the circulation of cooling fluid or liquid coolant through housing 25; however, while O-ring 49,59,69 of cylinder head 11 are preferably formed of a silicone rubber material for heat resistance purposes, it is contemplated that such O-rings may be formed of various other materials, such as a high temperature Buna-N rubber or the like for instance.

Adjustable means or adjustable combustion chamber dome 53 may be formed of any suitable metallic material, such as aluminum or the like for instance, and the adjustable means has a cylindric flange 73 integrally interposed between a pair of oppositely extending generally cylindric reduced end portions, such as inner end 75 and outer end 77. External circumscribed threads 79 are arranged about a circumferential section or portion of cylindric flange 73, and threads 79 are received in threaded engagement with internal threads 51 in larger stepped bore 39 of housing 25 upon the reception therein of adjustable means 53. Adjacent threads 79, a non-threaded circumferential section or portion 81 is disposed for sealing engagement with O-ring 49 seated in larger stepped bore 39 of housing 25. It may be noted that mating threads 51,79 are respectively of the type UNJ having a radius root and a radius tip; however, it is contemplated that various other types of threads may be utilized within the scope of the present invention.

Inner end 75 of adjustable means 53 is slidably received in smaller stepped bore 41 of housing 25, and a generally dome shaped combustion chamber 83 is defined in inner end 75 adjacent squish chamber 43 in lower end face 29 of housing 25. While combustion chamber 83 is illustrated herein as being generally dome shaped for purposes of disclosure, it is contemplated that other combustion chambers of various different shapes may be utilized within the scope of the present invention. While inner end 75 of adjustable means 53 may be slidably received in smaller stepped bore 41 of housing 25, it is contemplated that inner end 75 may be tapered radially inwardly from smaller stepped bore 41 within the scope of the present invention (as shown in FIG. 3) in order to accommodate expansion which may occur in response to heat of combustion within combustion chamber 83.

Outer end 77 of adjustable means 53 has a cylindric non-threaded section or portion 85 extending from cylindric flange 73 so as to be slidably received in bore 65 of cover 61 and arranged in sealing engagement with O-ring 69 seated therein. A threaded section or portion 87 is circumscribed about outer end 77 of adjustable means 53 generally adjacent non-threaded section 85 thereof, and threaded section 87 extends exteriorly of cover 61. A tool receiving or nut-shaped section 89 arranged adjacent threaded section 87 terminates outer end 77 of adjustable means 53 exteriorly of cover 61.

A locking means, such as a lock nut 91 or the like for instance, is threadedly engaged with the threads of threaded section 87 about outer end 77 of adjustable means 53 and arranged in releasable locking engagement with cover 61 about bore 65 therein. If desired, a metallic gasket 93 may be disposed in abutment between lock nut 91 and cover 61. A stepped bore or spark plug receptacle 95 extends generally axially through adjustable means 53 intersecting inner and outer ends 75,77 thereof with the smaller of the stepped bores being threaded at 97, and a spark plug (not shown) is adapted to be received in the stepped bore. To complete the description of cylinder head 11, it is contemplated that adjustable means 53 may be formed from a suitable metallic material, such as brass or the like for instance, different than the aforementioned metallic material from which housing 25 and cover 61 are formed within the scope of the present invention.

Figure 3:
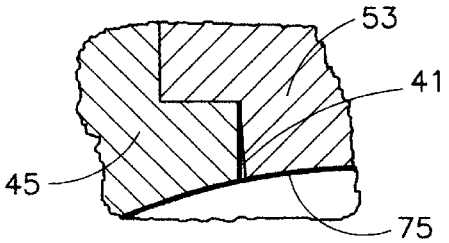
FIG. 3 is an enlarged fragmentary view taken from FIG. 1.

With reference now to a method in one form of the invention for adjustably establishing the volume of combustion chamber 83 in cylinder 15 of the aforementioned internal combustion engine (not shown), assume that the component parts of cylinder head 11 are in the positions described hereinbefore and as shown in FIGS. 1–3.

In order to adjust or vary the volume of combustion chamber 83, an operator may place a tool (not shown) in operating engagement with lock nut 91 to effect manual threaded rotation thereof relative to threaded section 87 on outer end 77 of adjustable means 53 and threadedly move the lock nut to a displaced position interrupting the aforementioned locking engagement of the lock nut between cover 61 and the outer end of the adjustable means.

Figure 6:
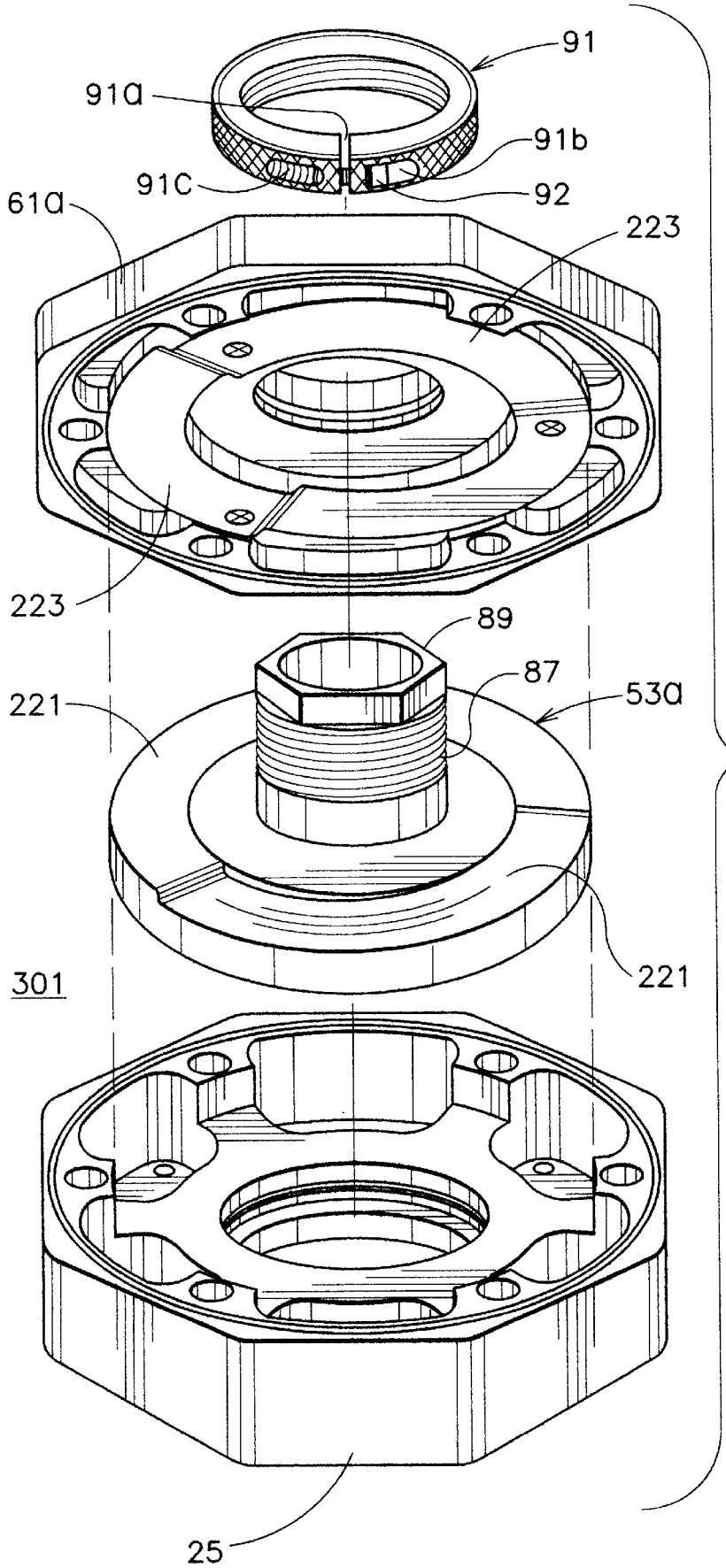
FIG. 6 is an enlarged view taken from FIG. 1 and illustrating one form of releasable securing means.

Referring briefly to FIG. 6, the lock nut 91 may be a split ring nut having a slit 91*a* and including a hole 91*b* on one side of the slit aligned with a threaded aperture 91*c* on an opposite side of the slit. A cap screw 92 having a head 92*a* positioned in and reacting on seat 91*d* in hole 91*b* threadedly engages aperture 91*c* and, when tightened, compresses the threads of nut 91 into threaded section 87 causing the threads to interlock and preventing loosening of nut 91. Moving the lock nut 91 thus requires initial releasing of screw 92.

With lock nut 91 so manually moved to its displaced position, as discussed above, the operator may associate a tool (not shown) with tool receiving section 89 or outer end 77 of adjustable means 53 to exert an applied rotative force F in one direction thereon, as indicated by the opposite rotational direction arrows in FIG. 1, and in response to the applied rotative force, the adjustable means is manually driven or rotated relative to housing 25 of cylinder head 11. It may be noted that the threaded engagement of circumscribed threads 79 on adjustable means 57 with internal threads 51 in larger stepped bore 41 of housing 25 is effective to translate the applied rotative movement of the adjustable means into vertical adjusting movement thereof relative to the housing. In response to the above discussed or translated vertical adjusting movement of adjustable means 53, it may be further noted that inner end 75 of the adjustable means is adjustably movable in smaller stepped bore 41 of housing 25 between the protracted adjusted position of inner end 75 in stepped bore 41, as shown in full line in FIG. 1, and the retracted adjusted position of inner end 75 in stepped bore 41, as designed by the dotted line L in FIG. 1. Of course, the above discussed adjusting movement of inner end 75 on adjustable means 53 within smaller stepped bore 41 into any preselected adjusted position between the aforementioned retracted and protracted adjusted positions is effective to vary the volume of combustion chamber 83, i.e., increase or decrease such volume, in order to adjust the performance of the internal combustion engine (not shown). In view of the foregoing, it may be noted that adjustable means 53 is manually adjustable into a preselected adjusted position in cylinder head 11 while the cylinder head is mounted on the internal combustion engine and without dismounting the cylinder head.

Upon the above discussed disposition of adjustable means 53 in its preselected adjusted position in cylinder head 11, the operator may associate a tool (not shown) in operating engagement with lock nut 91 to effect manual threaded rotation thereof on threaded section 83 of outer end 71 of the adjustable means and threadedly move the lock nut into the aforementioned locking or interlocking engagement between cover 61 and the outer end of the adjustable means. To complete the description of the adjusting method for cylinder head 11, it may be noted that locking means, such as the above discussed lock nut 91 or the like for instance, is operatively associated with adjustable means 53 for releasably retaining it in a selected or preselected adjusted position in housing 25.

Albeit not shown for purposes of brevity of disclosure and drawing simplification, adjustable means 53 may be threadedly disengaged from housing 25 and removed therefrom, if desired, when top cover 61 is displaced from the housing, as illustrated in FIG. 2, and upon such removal of adjustable means 53, it is contemplated that a replacement adjustable means defining a different combustion chamber may be inserted into or associated with the housing in the same manner as previously discussed with respect to adjustable means 53 within the scope of the present invention.

Figure 4:
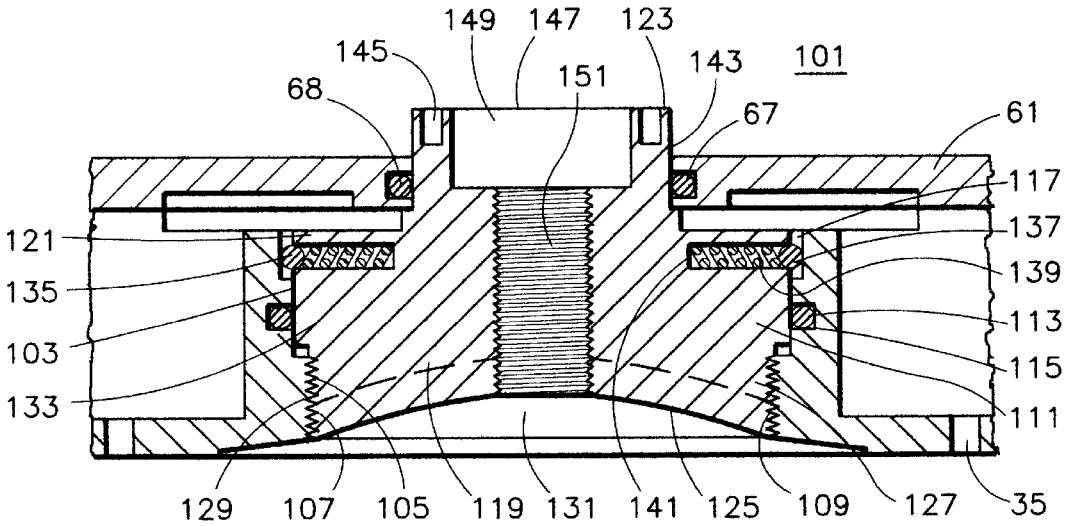
FIG. 4 is a partial sectional view showing an alternative cylinder head in one form of the invention in cross-section and illustrating principles which may be practiced in an alternative method of establishing the volume of a combustion chamber in a cylinder of an internal combustion engine also in one form of the invention.

With reference to FIG. 4, an alternative cylinder head 101 is shown in one form of the invention disassociated from engine block 13 of the internal combustion engine of FIG. 1 for the purpose of drawing simplification; however, cylinder head 101 has the same component parts operable in the same manner as those of the previously described cylinder 11 with the exceptions noted hereinafter.

In alternative cylinder head 101, housing 25 has a central aperture, such as a pair of stepped bores 103, 105 or the like for instance. Smaller stepped bore 105 has a threaded section or portion 107 with threads 109 extending internally about the smaller stepped bore, and larger stepped bore 103 defines a non-threaded section or portion 111 in housing 25.

Suitable sealing means such as an O-ring 113 or the like for instance, is sealably received or is seated in an annular groove 115 provided in larger stepped bore 103 adjacent smaller stepped bore 105, and a plurality of detents 117 are uniformly circumferentially spaced about the larger stepped bore extending between O-ring groove 115 and upper end face 27 of housing 25.

Adjustable means or adjustable combustion chamber dome 119 may be formed of brass, if desired, and has a cylindric flange 121 integrally interposed between a pair of generally cylindric reduced opposite extensions or end portions, such as an upper or outer end 123 and a lower or inner end 125. A threaded section or portion 127 on inner end 125 of adjustable means 119 has external circumscribed threads 129 extending thereabout, and circumscribed threads 129 are received in threaded engagement with internal threads 109 in smaller stepped bore 105 of housing 25 upon the reception thereon of adjustable means 119. If desired, threads 109, 129 may be of the aforementioned UNJ type having a radius root and a radius tip. Thus, inner end 125 on adjustable means 119 is threadedly received in smaller stepped bore 105 of housing 25, and a generally dome shaped combustion chamber 131 is defined in inner end 125 adjacent squish chamber 43 in lower end face 29 of housing 25. While combustion chamber 131 is illustrated herein as being generally dome shaped for purpose of disclosure, it is contemplated that other combustion chambers of various different shapes may be utilized within the scope of the present invention.

Upon the above discussed threaded engagement of threads 109, 129, a cylindric non-threaded section or portion 133 extending circumferentially about cylindric flange 121 of adjustable means 119 is arranged in sealing engagement with O-ring 113 seated in annular groove 111 in larger stepped bore 103 of housing 25, and a plurality of locking means 135 carried in cylindric flange 121 are arranged for releasable locking or interlocking engagement with detents 117 disposed in larger stepped bore 103 of housing 25. Locking means 135 comprises a plurality of resiliently urged means, such as bearings or balls 137 and springs 139, disposed in a plurality of generally radially extending blind holes or bores 141 in cylindric flange 121 of adjustable means 119 intersecting non-threaded sections 133 thereof, respectively. Thus, the resilient or compressive forces of springs 139 exerted on balls 137 urge the balls generally radially outwardly in blind bores 141 of adjustable means 118 for releasable abutting or locking engagement with detents 117 in larger stepped bore 103 of housing 25, as discussed in greater detail hereinafter. While only two locking means 135 and cooperative detents 117 are shown in FIG. 4, it is contemplated that either more or less of the locking means and cooperating detents may be utilized in cylinder head 101 within the scope of the present invention.

Outer end 123 of adjustable means 119 has a cylindric, non-threaded section or portion 143 extending from cylindric flange 121 so as to be slidably received in bore 65 of cover 61 in sealing engagement with O-ring 69 seated therein, and a plurality of tool receiving openings 145 are respectively provided in free end 147 of outer end 123. To complete the description of adjustable means 119, a spark plug receptacle or stepped bore 149 extends generally axially through adjustable means 119 respectively, intersecting inner end 125 and free end 147 on outer end 123 of the adjustable means with the smaller stepped bore being threaded at 151, and a spark plug (not shown) is adapted to be threadedly received in the stepped bore.

Referring now to an alternative method in one form of the invention for adjustably establishing the volume of combustion chamber 131 in cylinder 15 of the aforementioned internal combustion engine (not shown), assume that the component parts of cylinder head 101 are in the positions described hereinabove and as shown in FIG. 4.

In order to adjust or vary the volume of combustion chamber 131, an operator may place a tool (not shown) in operating engagement with tool receiving openings 145 of adjustable means 119 to exert an applied rotative force F1 in one direction thereon, as indicated by the opposite rotational direction arrows in FIG. 4, and in response to the applied rotative force the adjustable means is manually driven or rotated relative to housing 25 of cylinder head 101. It may be noted that the threaded engagement of circumscribed threads 129 on adjustable means 119 with internal threads 109 in smaller stepped bore 105 of housing 25 is effective to translate the above discussed applied force rotative movement of the adjustable means into vertical adjusting movement thereof relative to the housing. Thus, in response to the translated or vertical adjusting movement of adjustable means 119, as described above, it may be further noted that inner end 125 of the adjustable means is threadedly adjustably movable in smaller stepped bore 105 of housing 25 between the protracted adjusted position of inner end 125 in smaller stepped bore 105, as shown in full line in FIG. 4, and a retracted position of inner end 125 in smaller stepped bore, as designated by the dotted line L in FIG. 4. Of course the above discussed adjusting movement of inner end 125 on adjustable means 119 into any preselected adjusted position between the aforementioned retracted and protracted preselected adjusted positions is effective to vary the volume of combustion chamber 131, i.e., to increase or decrease such volume, in order to adjust the performance of the internal combustion engine (not shown).

During the above discussed adjusting movement of adjustable means 119 in housing 25 of cylinder head 101, the applied rotative force F1 exerted on the adjustable means is great enough to overcome the resilient forces of springs 139 urging balls 137 toward the above discussed releasable locking engagement thereof with detents 117 in larger stepped bore 103 of housing 25. However, when adjustable means 119 is adjustably moved to its preselected adjusted position, as discussed above, the adjustable means may be rotatably positioned in housing 25 to align balls 137 of locking means 135 with cooperating detents 117 in larger stepped bore 103 of housing 25, and the compressive forces of springs 139 are effective to engage or re-engage the balls in releasable locking engagement with the cooperating detents. To complete the description of the adjusting method for cylinder head 101, it may be noted that locking means 135 of adjustable means 119 is operatively associated with cooperating detents 117 larger stepped bore 103 of housing 25 for releasably retaining the adjustable means in a selected or preselected adjusted position in the housing.

Figure 5:
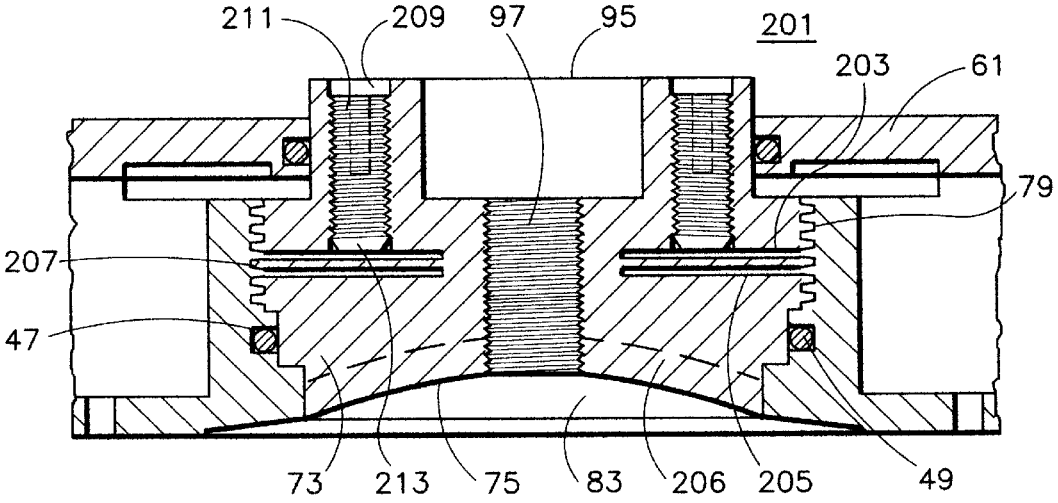
FIG. 5 is a partial sectional view showing another alternative cylinder head in one form of the invention in cross-section and illustrating principles which may be practiced in another alternative method of establishing a combustion chamber in a cylinder of an internal combustion engine also in one form of the invention.

As shown in FIG. 5, another alternative cylinder head 201 is shown in one form of the invention disassociated from engine block 13 of the internal combustion engine of FIG.

1 for the purpose of drawing simplification; however alternative cylinder head 201 has the same component parts operable in the same manner as the previously described cylinder head 11 with the exceptions discussed hereinbelow.

In alternative cylinder head 201, a pair of parallel slits or slots 203, 205 are provided in the threaded section of cylindric flange 73 between a set of adjacent circumscribed threads 79 provided on an adjustable means or adjustable combustion chamber dome 206, and the slits respectively intersect the radius roots of the threads so as to extend generally radially inwardly of the cylindric flange within the threads. It may be noted that slits 203, 205 define a flexible, yieldable or deformable threaded segment 207 in cylindric flange 73, as discussed in greater detail hereinafter. A generally vertical threaded opening 209 is provided in adjustable means 201 extending through outer end 77 into cylindric flange 73 and intersecting segment 207, and locking means, such as a threaded fastener or lock screw 211 or the like for instance, is threadedly received on threaded opening 209. Lock screw 211 has a non-threaded head or abutment end 213 associated in abutting engagement with flexible segment 207 for urging the flexure or displacement of the segment to effect the threaded interfering or locking engagement thereof with threads 79 in larger stepped bore 39 of housing 25 upon the threaded rotation of lock screw 211 in threaded opening 209, as discussed hereinafter. To complete the description of alternative adjustable means 201, lock screw 211 has a tool receiving opening 215 in the upper or free end 217 th of.

Referring now to another alternative method in one form of the invention for adjustably establishing the volume of combustion chamber 83 in cylinder 15 of the aforementioned internal combustion engine (not shown) assume that the component parts of alternative cylinder head 201 are disposed in cylinder head 11 in the positions discussed hereinabove and as shown in FIG. 5.

An operator may place a tool (not shown) in association with tool receiving section 88 on outer end 77 of adjustable means 206 to exert the applied rotative force F in one direction thereon, as indicated by the opposite rotative direction arrows in FIG. 5, and in this manner, adjustable means 206 is adjustably movable in housing 25 (in the same manner as previously discussed with respect to adjustable means 53) toward a preselected adjusted position to vary the volume of combustion chamber 83.

When adjustable means 206 is in the above discussed preselected adjusted position thereof, the operator may associate another tool, such as an Allen wrench or the like for instance (not shown) with tool receiving opening 215 in lock nut 211 to effect the threaded movement thereof in threaded opening 209. In response to this threaded movement of lock nut 211, abutment end 213 of the lock nut is driven into abutment or abutting engagement with flexible segment 207 in cylindric flange 73 of adjustable means 206 resulting in the resilient flexure or deformation of flexible segment 207. To complete the description of the alternative adjusting method for cylinder head 201, it may be noted that the above discussed deformation of flexible segment 207 effects interfering threaded engagement between the threads of flexible segment 207 and threads 51 in larger stepped bore 39 of housing 25 thereby to releasably secure adjustable means 206 against displacement from its preselected adjusted position in cylinder head 201.

Figure 7:
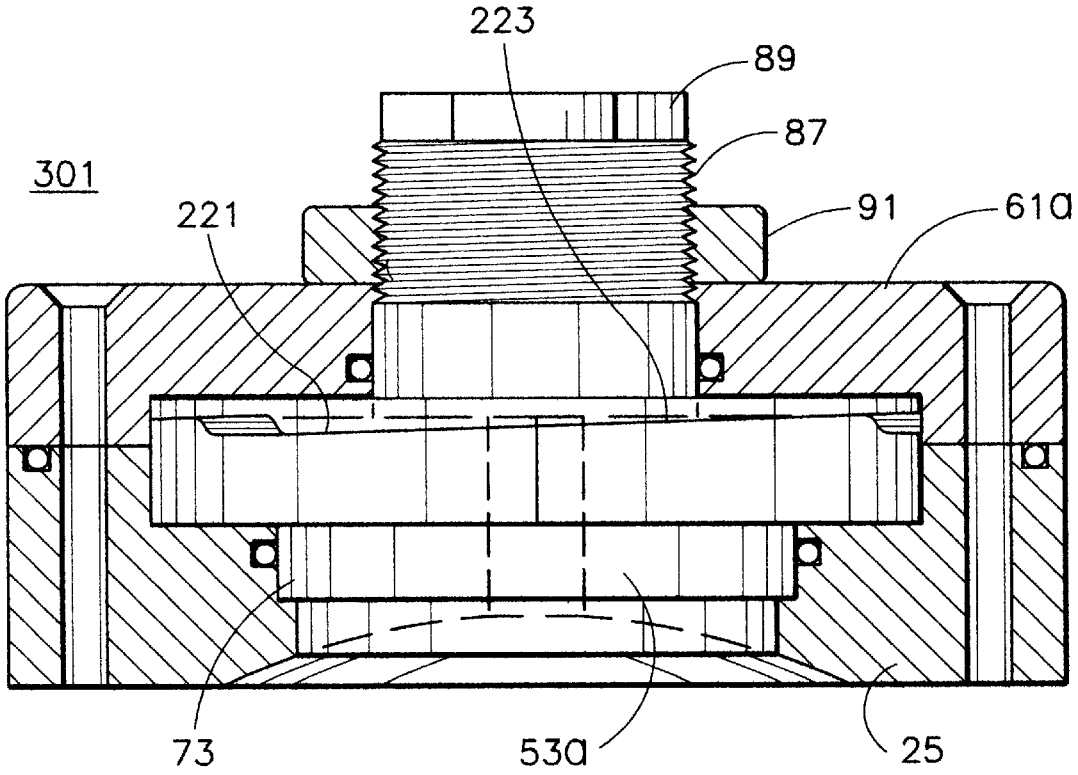
FIG. 7 is a partial sectional view showing another alternative cylinder head in one form of the invention in cross-section and illustrating principles which may be practiced in another alternative method of establishing a combustion chamber in a cylinder of an internal combustion engine also in one form of the invention.

Each of the embodiments of FIGS. 1, 4 and 5 utilize a threaded coupling between the adjustable means 53 and the housing 25. FIGS. 6 and 7 illustrate an alternative apparatus 301 and method for adjusting the relative position of means 53 in housing 25. In this embodiment, the means 53*a* has the general configuration of the means 53 of FIG. 1 but with the threaded portion 79 omitted from the flange 73. An upper surface 219 of flange 73 is formed with a plurality, preferably three, of arcuate cam segments 221. Each of the cam segments 221 mate with corresponding cam segments 223 formed on a lower surface of top cover 61*a*. As the adjustable means 53*a* is rotated, the relative position of means 53*a* within cylinder head 11 is adjusted by interaction between cam segments 221 and 223 using lock nut 91 to affect abutment between the segments 221 and 223.

In view of the foregoing, it is believed that novel cylinder heads are illustrated in each of FIGS. 1, 4, 5, 6 and 7 along with novel methods of adjustably establishing the volume of a combustion chamber in an internal combustion engine, and it is contemplated that changes in the arrangement, shapes and connections of the components of such cylinder heads, as well as the precise order of the steps of such methods, may be made by those having ordinary skill in the art without departing from the spirit of the disclosure of the present invention or from the scope thereof as defined by the claims which follow.

What is claimed is:

1. A cylinder head for an internal combustion engine comprising:

a head portion adapted for attachment to an engine cylinder, said head portion having a central aperture for receipt of an adjustable combustion chamber dome;

said dome having external circumscribed threads for engaging corresponding threads on an inner surface of said aperture in said head portion whereby said dome can be adjustably moved into a preselected adjusted position within said aperture by rotation of said dome with respect to said head portion; and locking means operatively associated with said dome for retaining said dome in the preselected adjusted position in said head portion, said locking means comprising at least one spring loaded bearing means positioned in a blind hole extending radially into said dome, said bearing means engaging a detent in said inner surface of said aperture for releasably retaining said dome against displacement from the preselected adjusted position thereof.

2. The cylinder head of claim 1 and including a plurality of said detents in said inner surface, said detents being generally uniformly, circumferentially spaced.

3. A cylinder head for an internal combustion engine comprising:

a head portion adapted for attachment to an engine cylinder, said head portion having a central aperture for receipt of an adjustable combustion chamber dome;

said dome having external circumscribed threads for engaging corresponding threads on an inner surface of said aperture in said head portion whereby said dome can be adjustably moved into a preselected adjusted position within said aperture by rotation of said dome with respect to said head portion;

said dome being defined by an inner end having a combustion chamber formed therein and an outer end having a spark plug receptacle formed therein and including an annular flange between said inner and outer ends, said external circumscribed threads being disposed about one of said flange and said inner end;

locking means operatively associated with said dome for retaining said dome in the preselected adjusted position in said head portion; and a removable top cover overlaying said head portion and having a central aperture for passage therethrough of said outer end of said dome.

4. The cylinder head of claim 3 wherein said inner end includes an inwardly tapered non-threaded portion.

5. The cylinder head of claim 3 wherein said dome comprises a machined brass member and said head portion comprises an aluminum member.

6. The cylinder head of claim 3 and including an annular groove formed in at least one of said flange of said dome and said inner surface of said head portion for receiving an O-ring, said O-ring reacting between said flange and said inner surface to prevent gas leakage therebetween.

7. The cylinder head of claim 3 wherein said threads are a type UNJ having a radius root and radius tip.

8. The cylinder head of claim 3 wherein said inner end includes a threaded portion with said external circumscribed threads being disposed about said threaded portion.

9. The cylinder head of claim 3 and including a plurality of cavities in said head portion adjacent said inner surface, liquid flow paths being formed between said cavities for circulating a liquid coolant through said head portion.

10. The cylinder head of claim 3 further comprising a replacement adjustable combustion chamber dome for receipt in said threaded aperture upon the removal therefrom of said first named dome when said top cover is removed from said head portion.

11. A cylinder head for an internal combustion engine comprising:

a head portion adapted for attachment to an engine cylinder, said head portion having a central aperture for receipt of an adjustable combustion chamber dome;

said dome having external circumscribed threads for engaging corresponding threads on an inner surface of said aperture in said head portion whereby said dome can be adjustable moved into a preselected adjusted position within said aperture by rotation of said dome with respect to said head portion;

locking means operatively associated with said dome for retaining said dome in the preselected adjusted position in said head portion; and said locking means comprising at least one pair of parallel slits extending radially inwardly of said dome within said threads of said dome for defining a flexible threaded segment, and means for flexing said segment for locking said dome threads to said threads in said head portion.

12. The cylinder head of claim 11 wherein said means for flexing comprising a fastener threadedly received in said dome and engaging said segment, said fastener having a head abutting a part of said segment for effecting the flexing of said segment upon rotation of said fastener.

13. A method of adjustably establishing the volume of a combustion chamber in a cylinder of an internal combustion engine, the cylinder including a cylinder head, and an adjustable means associated with the cylinder head for in part defining the combustion chamber in the cylinder, the method comprising the steps of:

exerting a manual rotative force on the adjustable means and rotating of the adjustable means relative to the cylinder head in response to the exerting step;

translating the rotation of the adjustable means effected during the rotating step into vertical adjusting movement of the adjustable means relative to the cylinder head;

varying the volume of the combustion chamber in response to the vertical adjusting movement of the adjustable means during the translating step; and the adjustable means including a flange having a surface formed with at least one cam shape and including a mating cam surface fixed with respect to the cylinder head for engaging the at least one cam surface whereby the step of translating includes sliding the at least one cam surface on the mating cam surface to effect the vertical adjusting movement of the adjustable means.

14. The method of claim 13 wherein the adjustable means includes a flange having a surface formed with at least one cam shape and including a mating cam surface fixed with respect to the cylinder head for engaging the at least one cam surface whereby the step of translating includes sliding the at least one cam surface on the mating cam surface to effect the vertical adjusting movement of the adjustable means.

15. The method of claim 14 and including a retaining nut for establishing a locking relationship between the at least one cam surface and the mating cam surface, the method including the further steps of releasing the retaining nut to enable rotation of the adjustable means and tightening the nut to secure the adjustable means in the cylinder head.

* * * * *